US010300501B2

(12) United States Patent
Morerod et al.

(10) Patent No.: US 10,300,501 B2
(45) Date of Patent: May 28, 2019

(54) LIQUID POLYMER ACTIVATION UNIT WITH IMPROVED HYDRATION CHAMBER

(71) Applicant: Velocity Dynamics, LLC, Louisville, CO (US)

(72) Inventors: Ryan G. Morerod, Greenwood, MO (US); Scott Leakey, Independence, MO (US)

(73) Assignee: Velocity Dynamics, LLC, Louisville, CO (US)

( * ) Notice: Subject to any disclaimer, the term of this patent is extended or adjusted under 35 U.S.C. 154(b) by 119 days.

(21) Appl. No.: 15/251,226

(22) Filed: Aug. 30, 2016

(65) Prior Publication Data

US 2017/0065957 A1 Mar. 9, 2017

Related U.S. Application Data

(60) Provisional application No. 62/214,024, filed on Sep. 3, 2015, provisional application No. 62/317,960, filed on Apr. 4, 2016.

(51) Int. Cl.

| | |
|---|---|
| ***B05B 1/00*** | (2006.01) |
| ***B05B 1/34*** | (2006.01) |
| ***B01F 5/00*** | (2006.01) |
| ***B01F 5/02*** | (2006.01) |

(52) U.S. Cl.

CPC ..... *B05B 1/3405* (2013.01); *B01F 5/0287* (2013.01); *B01F 2215/0049* (2013.01)

(58) Field of Classification Search

CPC . B05B 1/00; B05B 1/34; B05B 1/3405; B01F 5/00; B01F 5/02; B01F 5/0281; B01F 5/0287; B01F 2215/00; B01F 2215/0001; B01F 2215/0049

See application file for complete search history.

(56) References Cited

U.S. PATENT DOCUMENTS

| | | | |
|---|---|---|---|
| 4,057,223 | A | 11/1977 | Rosenberger |
| 4,087,862 | A | 5/1978 | Tsien |
| 4,123,800 | A | 10/1978 | Mazzei |
| 4,233,265 | A | 11/1980 | Gasper |
| 4,274,749 | A | 6/1981 | Lake et al. |
| 4,289,732 | A | 9/1981 | Bauer et al. |
| 4,416,610 | A | 11/1983 | Gallagher, Jr. |
| 4,533,254 | A | 8/1985 | Cook et al. |
| 4,738,614 | A | 4/1988 | Snyder et al. |
| 4,944,602 | A | 7/1990 | Buschelberger |

(Continued)

*Primary Examiner* — Natasha E Young
(74) *Attorney, Agent, or Firm* — Erickson Kernell IP, LLC; Kent R. Erickson

(57) ABSTRACT

A polymer activation assembly is provided for separating monomer from the oil in which it is suspended in a polymer forming suspension and mixing the monomer with water supplied from another stream. The supply water is supplied through a primary fluid channel extending through the activation assembly and which transitions to a relatively wide rectangular activation channel. A secondary fluid inlet is formed in a side of the activation assembly for injection of the polymer forming suspension therein. A nozzle section of the secondary fluid inlet is formed between an initial section of the inlet and the activation channel. The nozzle section is generally rectangular in cross section and relatively shallow. The distal end of the nozzle section has a width that approximates the width of the activation channel. The nozzle section angles at an acute angle toward the outlet.

19 Claims, 7 Drawing Sheets

(56) References Cited

U.S. PATENT DOCUMENTS

| | | | |
|---|---|---|---|
| 5,316,031 | A | 5/1994 | Brazelton et al. |
| 5,388,905 | A | 2/1995 | Ake et al. |
| 5,426,137 | A | 6/1995 | Allen |
| 5,470,150 | A | 11/1995 | Pardikes |
| 5,820,256 | A | 10/1998 | Morrison |
| 6,451,265 | B1 | 9/2002 | Misuraca |
| 6,802,640 | B2 | 10/2004 | Schubert et al. |
| 7,267,477 | B1 | 9/2007 | Plache |
| 8,398,866 | B2 | 3/2013 | Ozawa et al. |
| 2003/0189871 | A1 | 10/2003 | Brick et al. |
| 2003/0227820 | A1 | 12/2003 | Parrent |
| 2008/0144430 | A1 | 6/2008 | Serafin et al. |

LIQUID POLYMER ACTIVATION UNIT WITH IMPROVED HYDRATION CHAMBER

CROSS-REFERENCE TO RELATED APPLICATIONS

This application claims priority to U.S. Provisional Patent Application No. 62/214,024 filed Sep. 3, 2015 and U.S. Provisional Patent Application No. 62/317,960 filed Apr. 4, 2016, the disclosures of which are incorporated herein by reference, in their entirety.

FIELD OF THE INVENTION

This invention relates to a fluid blending apparatus for activating polymer forming compounds suspended in oil and mixing the polymers with water to hydrate and polymerize the polymer forming compounds.

BACKGROUND OF THE INVENTION

In the water treatment industry it is known to use activated polymers to bind with and help remove suspended solids in a water stream. One type of activated polymer is formed by mixing an emulsion of oil and polymer forming compounds with water to initiate the polymerization reaction. The polymer forming compounds which may comprise monomers or oligomers react in the presence of water to polymerize. The monomers are therefore supplied emulsified in oil and a surfactant to prevent polymerization until desired. The oil must be separated from or stripped away from the monomer in the presence of water to initiate polymerization which may be referred to as activating the polymer.

A common polymer activation system involves injecting the monomer and oil mixture into a stream of water in a pipe and at an acute angle with the mixing action then separating the monomer from the oil to initiate polymerization. It is also believed that the impact of the monomer and oil mixture against the wall of the pipe results in some physical stripping of oil from the monomer. U.S. Pat. No. 7,267,477 to Paul R. Plache shows a prior art mixing system with a round, secondary fluid insertion channel flowing into a round primary fluid inlet channel at an acute angle. However, there remains a need for activation systems which are more efficient and result in a greater degree of polymerization of the monomer feed. More efficient polymerization will result in more efficient solids removal.

SUMMARY OF THE INVENTION

The present invention is a polymer activation assembly for separating monomer from oil in which it is suspended in a polymer forming suspension and mixing the monomer with water supplied from another stream. The supply water or process water is supplied through a primary fluid channel extending through the activation assembly and which transitions from a circular cross-section inlet to a relatively wide but shallow rectangular cross-section passageway or activation channel that is considerably wider than it is deep. At the opposite end of the activation assembly from the inlet, the passageway transitions back to a circular cross section for the outlet. A secondary fluid inlet is formed in a side of the activation assembly for injection of the polymer forming suspension therein. The initial section of the secondary fluid inlet is formed as a circular cross-section passageway. The axis of the initial section of the secondary fluid inlet may extend perpendicular to the activation channel. A nozzle section of the secondary fluid inlet is formed between the initial section of the inlet and the activation channel. The nozzle section is generally rectangular in cross section and relatively shallow relative to its width. The distal end of the nozzle section has a width that approximates the width of the activation channel and a relatively shallow height. The nozzle section also angles at an acute angle toward the outlet of the water passageway. In a preferred embodiment, the angle will be approximately 45 degrees but any acute angle should suffice.

The polymer suspension is injected into the water stream through the nozzle section of the secondary fluid inlet and against the flat or planar and relatively wide surface of the activation channel opposite the nozzle outlet. The relatively wide area of impact improves separation of the oil from the monomer in the polymer forming suspension and more thorough mixing which then results in more thorough and efficient polymerization of the monomer. It is believed that the resulting polymer strands tend to be longer and the ability of the polymer to remove suspended particles from the treated water is improved.

DETAILED DESCRIPTION OF THE PREFERRED EMBODIMENTS

Figure 1:
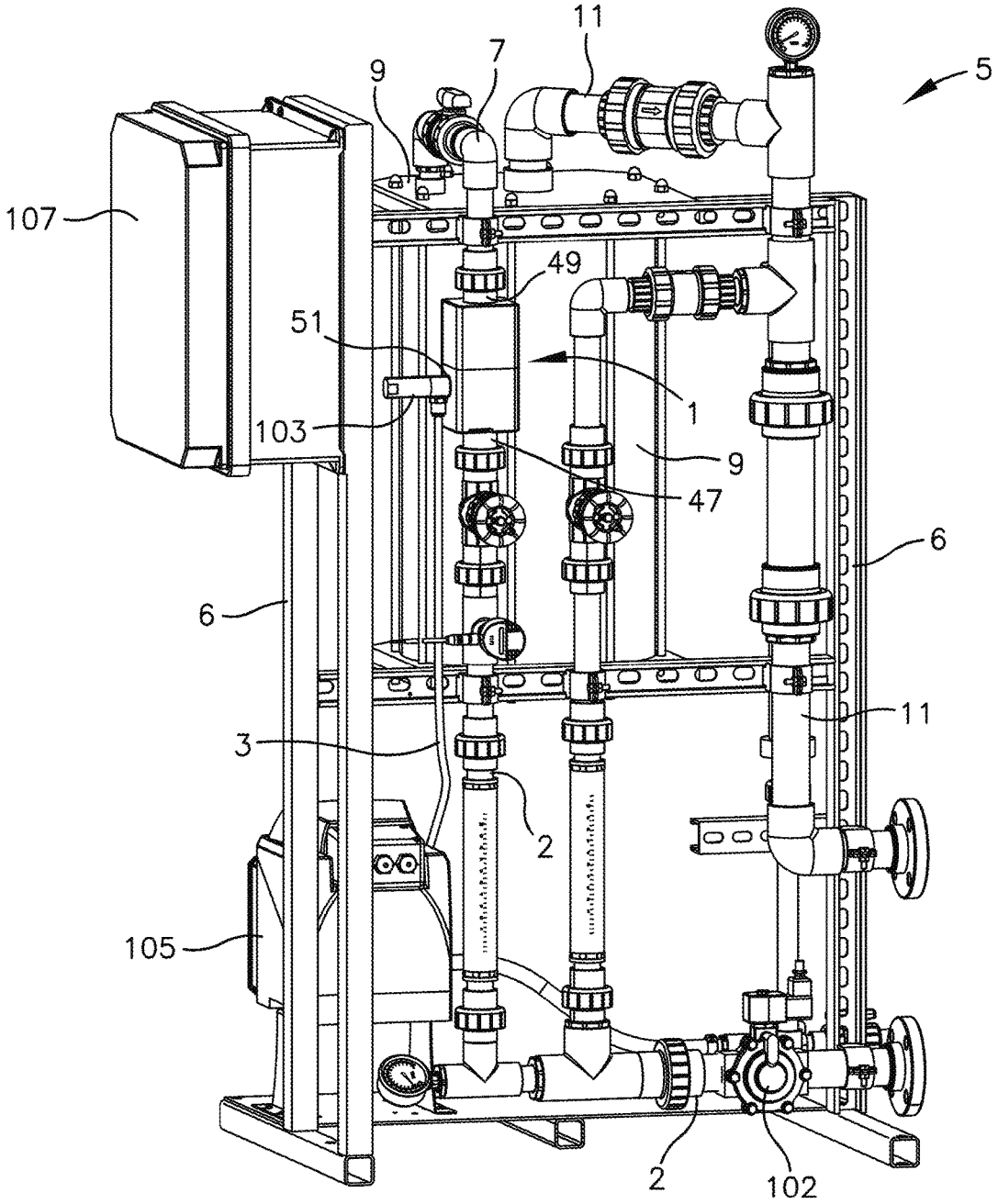
FIG. 1 is a front perspective view of a polymer activation system including a polymer activation assembly for use in activating and mixing a polymer forming suspension in a secondary fluid stream with water in a primary fluid stream.
Figure 2:
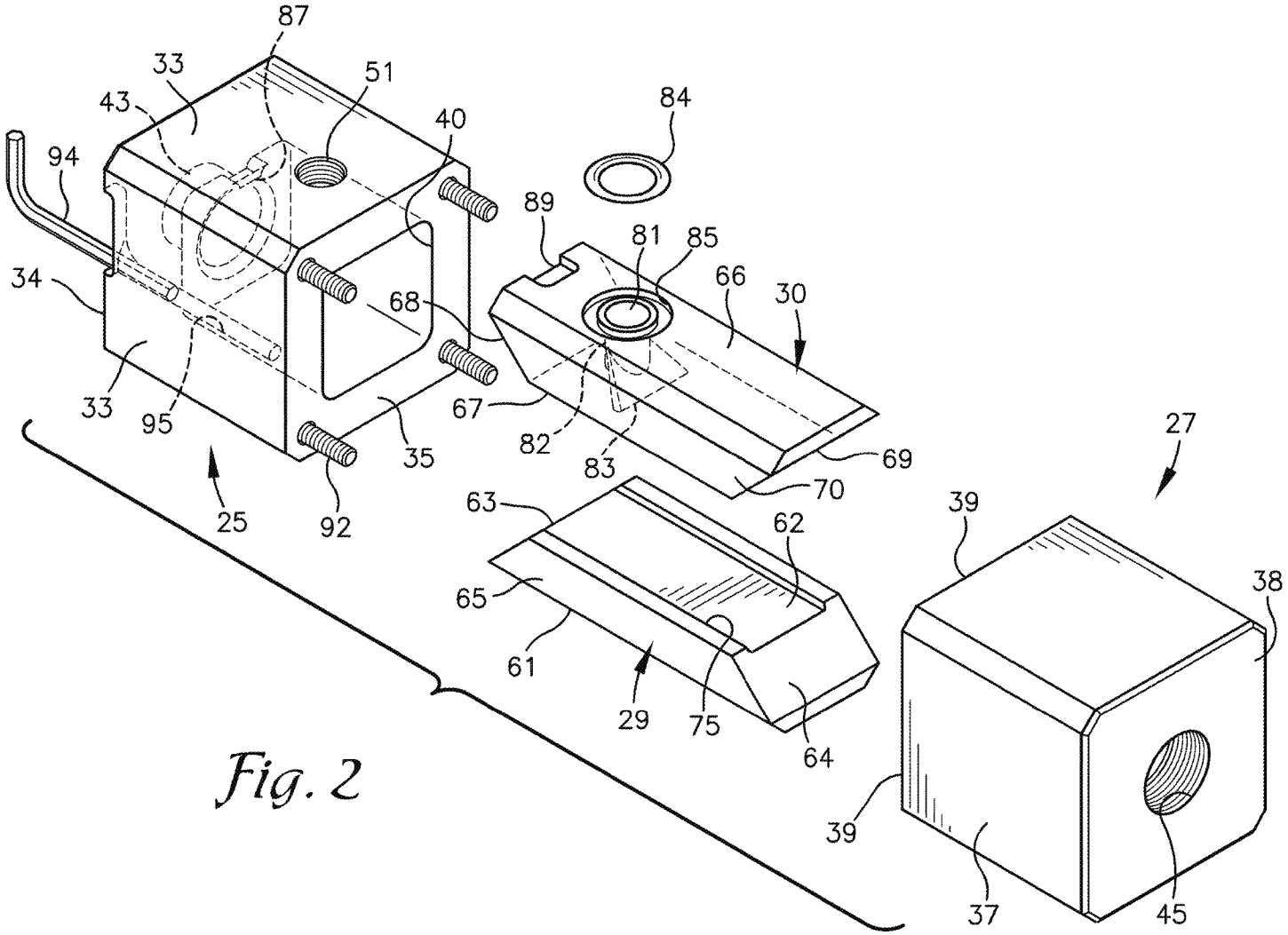
FIG. 2 is an exploded perspective view of the polymer activation assembly.
Figure 3:
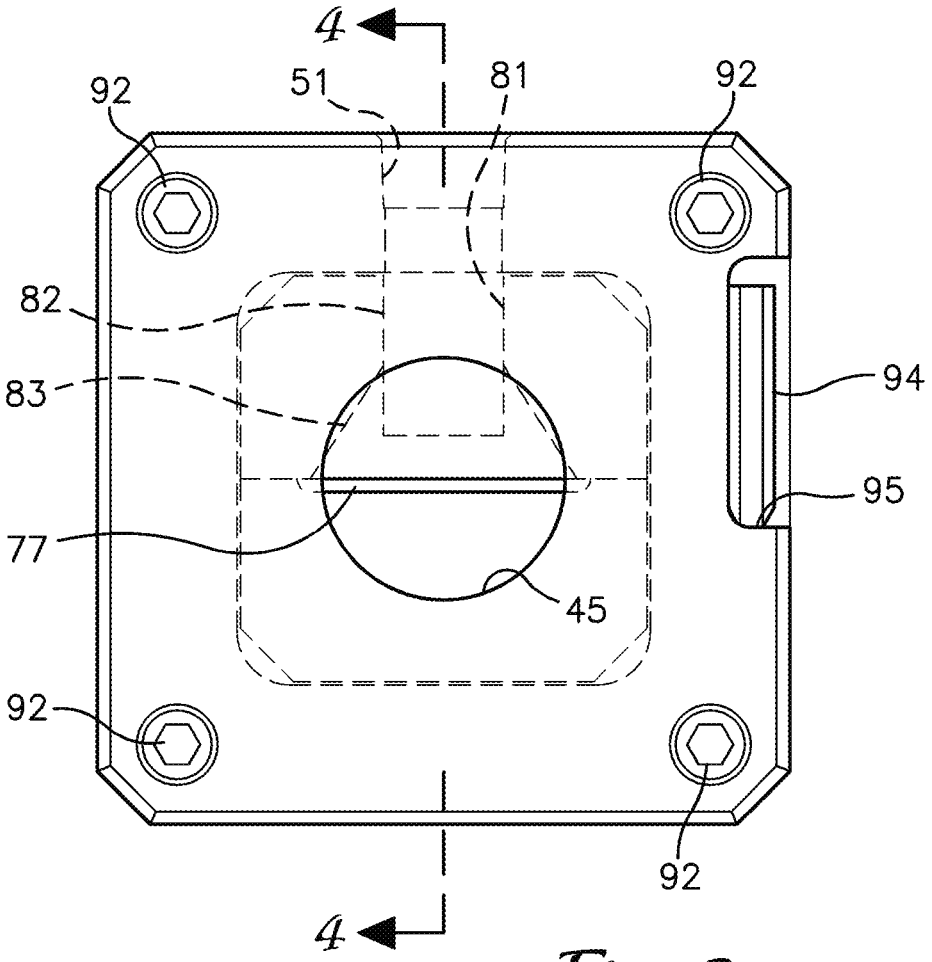
FIG. 3 is an end view of the polymer activation assembly.
Figure 4:
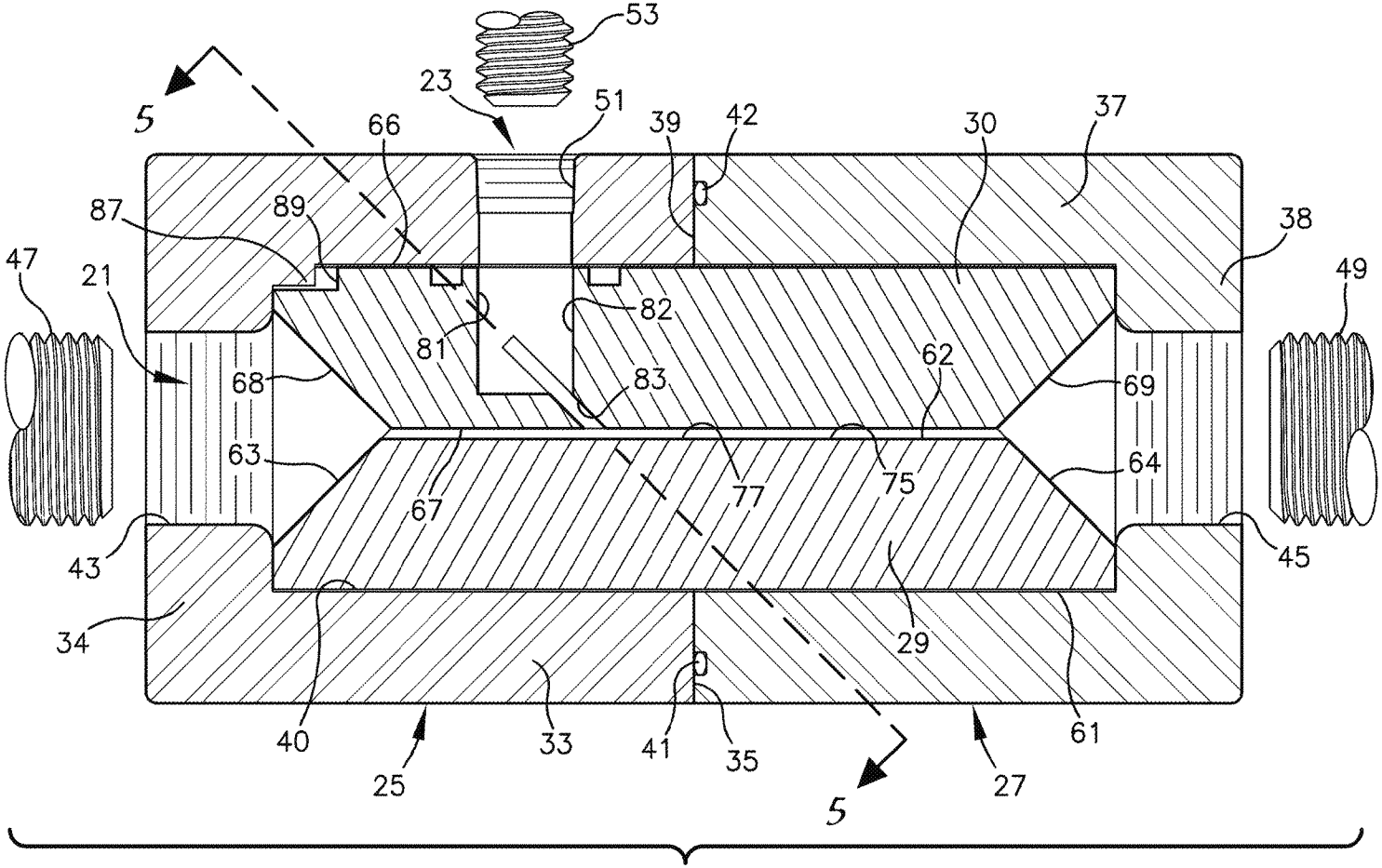
FIG. 4 is a cross-sectional view of the polymer activation assembly taken along line 4-4 of FIG. 3 with portions of fittings connected to primary and secondary fluid inlets and a mixed fluid outlet.
Figure 6:
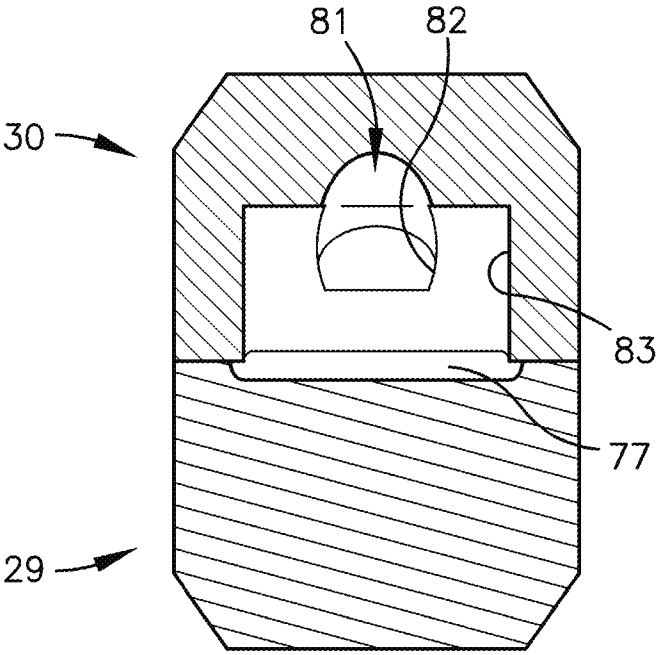
FIG. 6 is a cross-sectional view similar to FIG. 5 showing an alternative geometry of the slot for injecting polymer forming suspension into the primary fluid channel.
Figure 5:
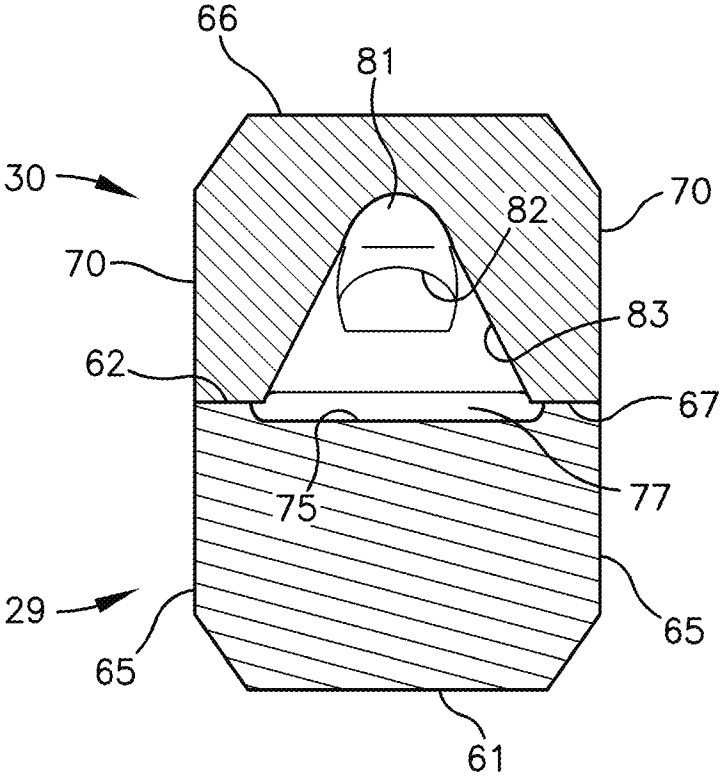
FIG. 5 is a fragmentary cross-sectional view taken along line 5-5 of FIG. 4 showing a tapered slot through which the polymer forming suspension is injected into a relatively shallow, primary fluid channel formed in the polymer activation assembly and against a flat surface of the portion of the assembly forming the primary fluid channel.
Figure 7:
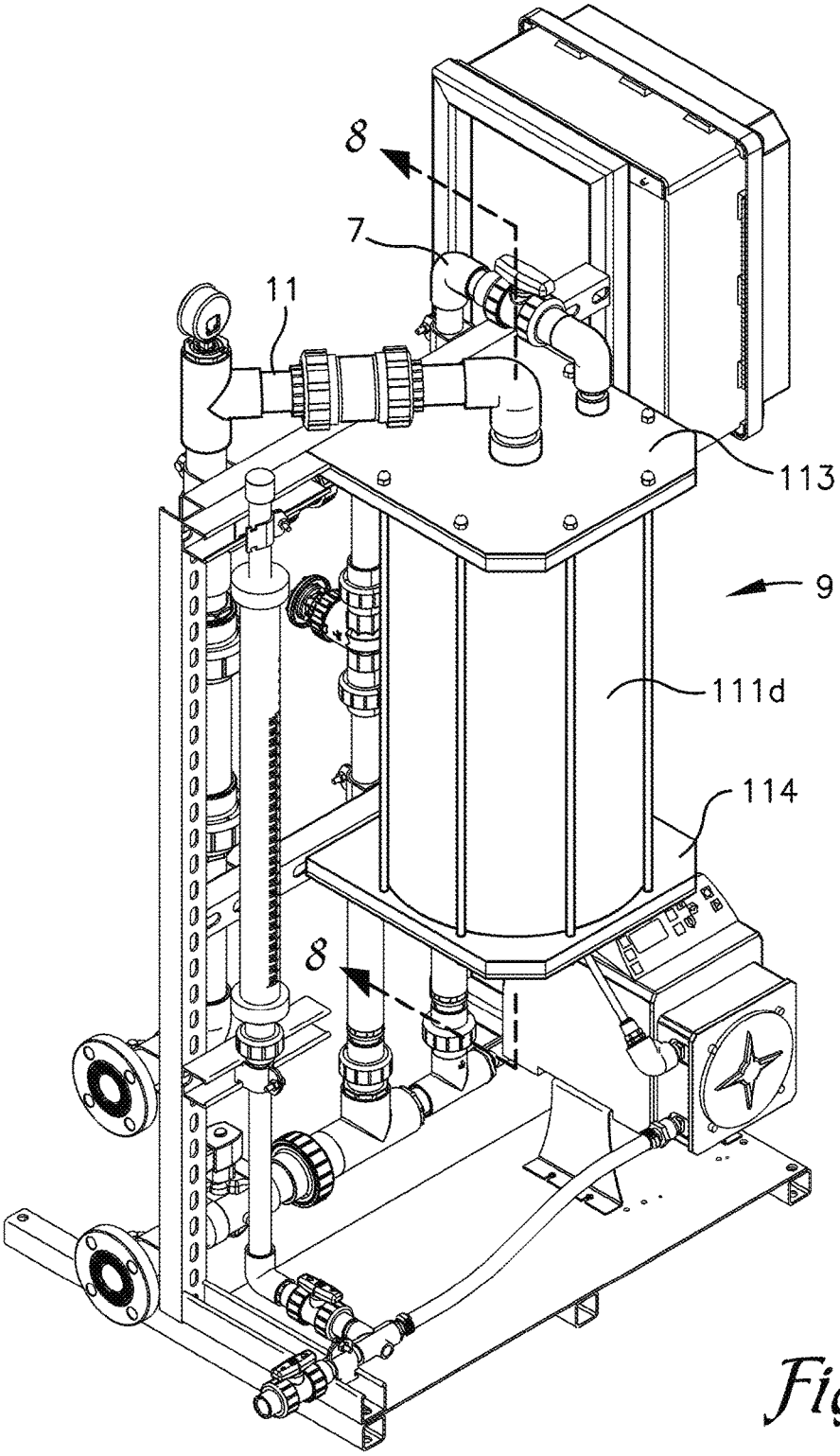
FIG. 7 is a rear perspective view of the polymer activation system showing the hydration chamber included therein.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 1 refers to an activation assembly or high energy activation unit 1 for mixing primary and secondary fluids. In one embodiment, the primary fluid comprises supply water and the secondary fluid comprises a polymer forming suspension which may include monomers or other polymer forming compounds dispersed in oil with a stabilizing surfactant maintaining the monomers in suspension. Shear induced by the activating assembly 1 separates the monomer from the oil and mixes the monomer with the supply water. The monomer then polymerizes in the supply water forming a coagulant. The supply water and coagulant mixture may then be mixed with water to be purified in a downstream process in which the coagulant attracts and coagulates with suspended particles in the water to be purified which may be waste water.

Supply water is introduced into the activation assembly 1 through a primary fluid supply line 2 with the polymer forming suspension introduced through a secondary fluid supply line 3. The activation assembly 1, is shown in FIG. 1 installed in an exemplary polymer activation system 5 mounted on frame 6. Supply water mixed with the polymer forming suspension flows out of activation assembly 1 through outlet line 7 to hydration chamber 9. Hydration chamber 9 provides residence time to increase the extent of polymerization of monomers or other polymer forming compounds in the polymer forming suspension to form a coagulant. The supply water and polymer mixture flows out of the hydration chamber 9 through discharge line 11 to downstream processes (not shown) for mixing the supply water and coagulant mixture with water to be purified such that the polymer coagulates with suspended solids in the water. Additional process steps are utilized for separating the water from the coagulant.

The polymer activation assembly 1 includes a primary fluid channel 21 intersected by a secondary fluid or polymer forming suspension feed channel 23. The primary fluid channel 21 extends longitudinally through the activation assembly 1 and the secondary fluid channel 23 enters the activation assembly 1 transverse to and then intersects the primary fluid channel 21 at an acute angle. The body of the activation assembly 1 shown is formed from four primary components, an inlet casing 25, an outlet casing 27 and first and second activation channel forming blocks or members 29 and 30. The inlet and outlet casings 25 and 27 are generally formed as hollow cubes. Inlet casing 25 includes four sidewalls 33, an end wall 34 and an open end 35 opposite end wall 34. Outlet casing 27 similarly includes four sidewalls 37, an end wall 38 and an open end 39 opposite the end wall 38. Inlet and outlet casings 25 and 27 may be bolted together with open ends 35 and 39 facing each other with end walls 34 and 38 extending across opposite ends of the assembly to form an interior chamber 40. An O-ring 41 is positioned between the casings 25 and 27 to form a seal therebetween. In the embodiment shown, the O-ring 41 is positioned in an O-ring receiving groove 42 formed in the open end of the outlet casing 27.

A primary fluid inlet 43, which may comprise a threaded bore, extends through inlet casing end wall 34. Similarly, a mixture outlet 45, which may comprise a threaded bore, extends through outlet casing end wall 38. Inlet fitting 47 threadingly coupled to inlet casing end wall 34 in primary fluid inlet 43 connects the water supply line 2 to the inlet casing end wall 34 of activation assembly 1. Outlet fitting 49, threadingly coupled to outlet casing end wall 38 in mixture outlet 45, connects outlet line 7 to the outlet casing end wall 38 of activation assembly 1. A secondary fluid inlet 51, which may comprise a threaded bore, is formed through one of the sidewalls 33 of inlet casing 25. Secondary fluid inlet fitting 53, threadingly coupled to inlet casing sidewall 33, connects the secondary fluid supply line 3 to the activation assembly 1.

The first and second activation channel forming blocks 29 and 30 are positioned in and held in place in interior chamber 40 in abutting relationship. First activation channel forming block 29 includes an outer surface 61, inner face 62, inlet and outlet ends 63 and 64 and opposed sides 65. Second activation channel forming block 30 similarly includes outer surface 66, inner face 67, inlet and outlet ends 68 and 69 and opposed sides 70. Blocks 29 and 30 are positioned within the interior chamber 40 so that the inner faces 62 and 67 abut each other and the outer surfaces 61 and 66 extend outward against sidewalls 33 of the inlet and outlet casings 25 and 27. A groove 75 is formed in the inner face 62 of first block 29. Groove 75 is preferably rectangular in cross-section and relatively wide and shallow. In the embodiment shown, groove 75 extends across a substantial portion of the width of the first block 29. More specifically, the width of groove 75 is approximately seventy to seventy five percent of the width of the block 29.

Groove 75 is also relatively shallow and in the embodiment shown, groove 75 is twenty two times wider than it is deep although grooves having lesser or greater ratios may be utilized including grooves that are up to twenty to thirty times wider than they are deep are foreseen. As an example, in a block 29 having a width of 1.9063 inches, the groove 75 is 1.375 inches wide and 0.0625 inches deep.

The inner face of 67 of second block 30 is generally planar and covers the groove 75 when the first and second blocks 29 and 30 are secured in place to form an activation channel 77 running the length of the interface between the inner faces 62 and 67 of blocks 29 and 30. Activation channel 77 is relatively wide and shallow with the same relative dimensions as groove 75.

The inlet ends 63 and 68 of first and second blocks 29 and 30 each slope inward from respective outer surfaces 61 and 66 to respective inner faces 62 and 67. The slope of the inlet ends 63 and 68 may vary but forty five degrees is a preferred slope or angle. When the first and second blocks 29 and 30 are secured in abutting relationship in interior chamber 40 with their inner faces 62 and 67 abutting, the inwardly sloped ends 63 and 68 generally form a funnel sloping inward toward the activation channel 77 to funnel or direct supply water from the primary fluid inlet 43 into the activation channel 77.

A secondary fluid inlet injection port 81 is formed in the second block 30 and includes an inlet section 82 and a nozzle section 83. Inlet section 82 of injection port 81 is formed as a cylindrical bore and aligns with the secondary fluid inlet 51 in inlet casing 25 when blocks 29 and 30 are properly positioned in interior chamber 40. In the embodiment shown, inlet section 82 is of the same diameter as secondary fluid inlet 51. Axes of inlet section 82 and secondary fluid inlet 51 extend perpendicular to sidewall 33 through which the secondary fluid inlet 51 extends. An O-ring 84 may be received in an O-ring receiving groove 85 formed in outer surface 66 of second block 30 around injection port 81.

The nozzle section 83 of injection port 81, is formed as a relatively shallow slot intersecting with and extending from a lower portion of the inlet section 82 to the inner face 67 of the second block 30. The slot 83 shown is rectangular in cross-section and flares outward from its intersection with the cylindrical inlet section 82 to an outlet extending through the inner face 67. The width of slot 83 where it intersects at the inlet section 82 is approximately equal to the diameter of the inlet section 82 of injection port 81 and the width of slot 83 at inner face 67 is approximately equal to the width of the groove 75 in first block 29 with which it is aligned. The slot 83 slopes towards the outlet end 69 from the injection port 81 to the inner face 67 at an acute angle. In the embodiment shown, the slope of slot 83 is forty five degrees. However other angles may suffice including angles between thirty and sixty degrees or zero and ninety degrees. The depth of the slot 83 is similar to the depth of groove 75 but in one embodiment is approximately fifty percent greater. It is foreseen slot 83 could be machined into the block 30 without a taper such that it is of constant width.

The outlet ends 64 and 69 of blocks 29 and 30 angle outwards from the inner face 62 and 67 to the respective outer surfaces 61 and 66 of the blocks 29 and 30 so that the spacing between the sloped outlet ends 64 and 69 at the distal end thereof approximates the diameter of the mixture outlet 45 through outlet casing end wall 38. The inlet ends 63 and 68 and outlet ends 64 and 69 of blocks 29 and 30 may be flattened adjacent the corner formed with the respective outer surface 61 and 65.

Proper positioning of blocks 29 and 30 is ensured by a locating tab or projection 87 formed on the inlet casing sidewall 33 through which the secondary fluid inlet 51 extends. In the embodiment shown, the tab 87 is formed adjacent the inlet casing end wall 34 and extends longitudinally toward the open end 35 of the inlet casing. A mating locating slot 89 is formed in the outer surface 66 of the second activating channel forming block 30. Locating slot 89 is open along the inlet end 68 of second block 30. If during assembly, the assembler mistakenly attempts to install the first activation channel forming block 29 with its outer surface 61 abutting the inlet casing sidewall 33 through which the secondary fluid inlet extends, the locating tab 87 will prevent the inlet end 63 of block 29 from sitting flush against the inlet casing end wall 34 which will prevent the outlet casing 27 from being positioned in abutting relationship with inlet casing 25 over the blocks 29 and 30.

The outlet casing 27 may be secured to the inlet casing 25 by a plurality of bolts 92, four in the embodiment shown, inserted through aligned bores extending through corners of the inlet and outlet casings 25 and 27. One or both of the aligned bores may be threaded to threadingly receive the bolts 92. A driver 94, such as an Allen wrench or hex key, may be provided to facilitate assembly. A bore or receiver 95 may be formed in one of the casings 25 or 27 in which the driver may be secured when not in use.

The flow of supply water through the polymer activation assembly 1 installed in activation system 5 is controlled using solenoid valve 102 on water supply line 2. The flow of polymer forming suspension through polymer activation assembly 1 is controlled using check valve 103 which is shown mounted on secondary fluid inlet fitting 53. Pump 105 pumps polymer forming suspension from a container (not shown) into the polymer supply line 3 and to activation assembly 1. The container may be a drum positioned proximate the frame 5. Operation of the pump 105, check valve 103 and solenoid valve 102 is controlled by controller 107 mounted on frame 6. Because the volume of polymer forming suspension to be supplied relative to the amount of supply water passing through the assembly 1 is typically relatively small, check valve 103 may be a pulsing type valve or controlled by controller 107 to pump polymer forming suspension into the activation assembly 1 in pulses.

Supply water is fed into activation assembly 1 under system pressure produced upstream of the activation system 5. The supply water flows through the primary fluid channel 21 in activation assembly 1 which is formed by the primary fluid inlet 43, the activation channel 77 and the mixture outlet 45. Polymer forming suspension is injected or directed into the activation channel 77 through the secondary fluid channel 23 which is formed by the secondary fluid inlet 51 in inlet casing 25 and the secondary fluid injection port 81 in second activation channel forming block 30. Polymer forming suspension directed through the nozzle segment 83 of injection port 81 is directed into the stream of supply water in the activation channel 77 and against the inner face 62 of the first activation channel forming block in activation channel 77. The section of the activation channel 77 into which the polymer forming suspension is injected into from the secondary fluid channel 23 may be referred to as the activation portion of the activation channel 77. The high energy impact of the polymer forming suspension against the inner face 62 within groove 75, along the activation portion of the activation channel 77, facilitates separation of the oil from the monomer in the suspension and mixing of the monomer with the supply water to initiate the polymer reaction and increase the surface area of monomer free from oil to react and polymerize.

The nozzle segment 83 of injection port 81 is angled towards the outlet ends 64 and 69 of activation channel forming blocks 29 and 30 to direct the polymer forming suspension downstream towards the mixture outlet 45 and reduce backflow. The mixture of supply water and activated polymer forming suspension is then carried through outlet line 7 to the hydration chamber 9 having sufficient retention time to permit a desirable amount of polymer chain growth. The outflow from the hydration chamber 9 passes through discharge line 11 to downstream systems in which the supply water and polymer mixture is mixed with water to be purified and containing suspended solids. The suspended solids are attracted to and bound up in the polymer coagulant and then separated from the water in subsequent separation systems.

Figure 8:
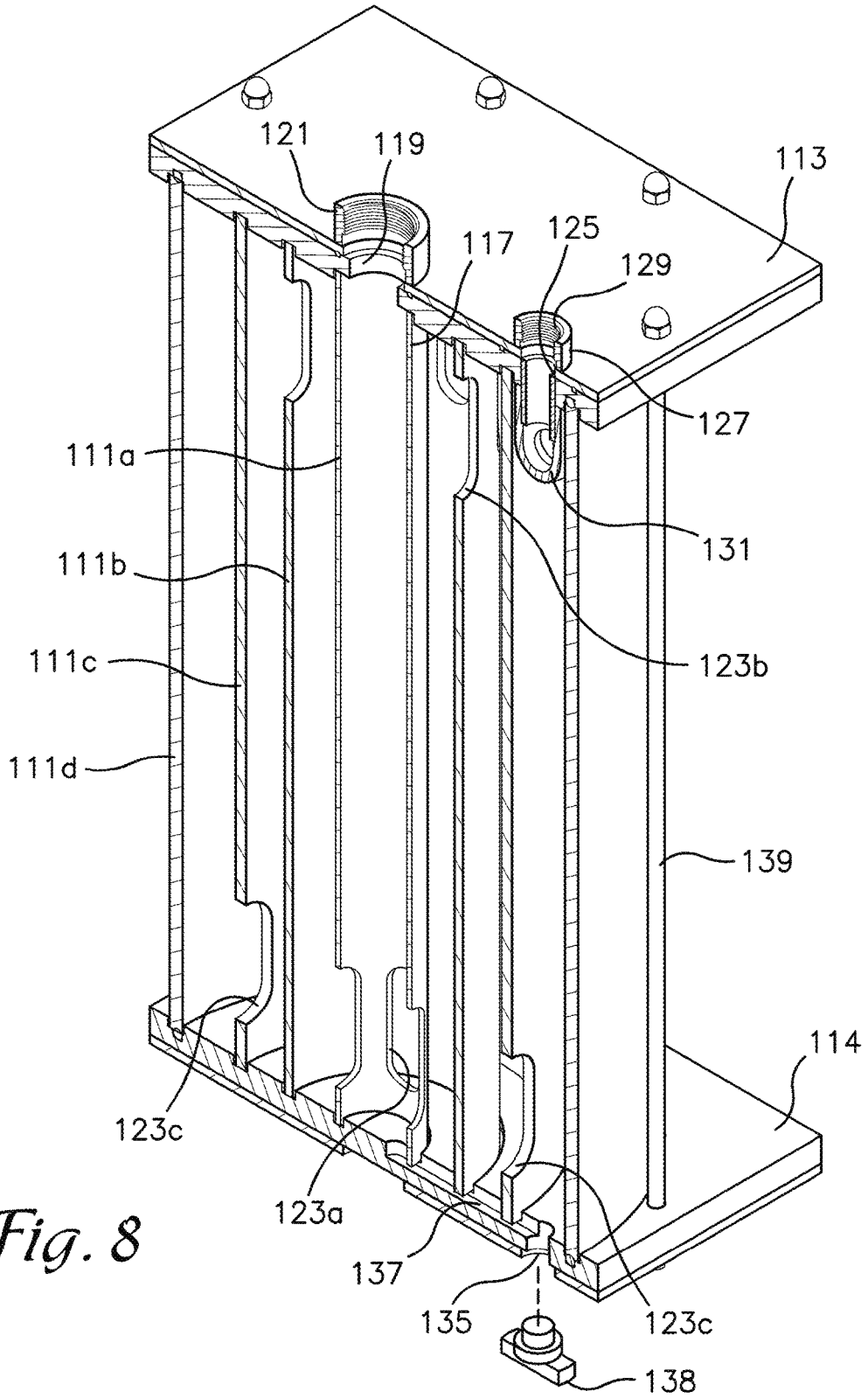
FIG. 8 is an enlarged and fragmentary, cross-sectional view of the hydration chamber taken along line 8-8 of FIG. 7.

Referring to FIG. 8, the hydration chamber 9 comprises a plurality of interconnected, concentric chambers formed by a plurality of cylindrical shells 111 of increasing diameter secured between upper and lower mounting plates 113 and 114. In the embodiment shown, there are four cylindrical shells 111*a-d*. Innermost shell 111*a* generally comprises an elongate section of pipe mounted centrally relative to the upper and lower mounting plates 113 and 114 with an outlet end 117 of the innermost shell 111*a* aligned with an outlet opening 119 through the upper mounting plate and connected to a threaded outlet fitting 121 connected to the outer surface of the upper mounting plate 113 and surrounding the outlet opening 119. Discharge line 11 is threadingly coupled to outlet fitting 121.

A plurality of openings or passageways 123*a* are formed through the side of the innermost shell 111*a* near a lower end thereof to permit fluid to flow into the innermost shell 111*a* through the passageways 123*a* from the space between innermost shell 111*a* and second shell 111*b*. A plurality of openings or passageways 123*b* are formed through the side of the second shell 111*b* near an upper end thereof to permit fluid to flow into the space between the second shell 111*b* and the innermost shell 111*a* through passageways 123*b* from the space between second shell 111*b* and third shell 111*c*. A plurality of openings or passageways 123*c* are formed through the side of the third shell 111*c* near a lower end thereof to permit fluid to flow into the space between the third shell 111*c* and second shell 111*c* through passageways 123*c* from the space between third shell 111*c* and the outermost shell 111*d*.

An inlet opening 125 is formed through the upper mounting plate 113 in line with the space between the third and fourth shells 111*c* and 111*d* and an inlet fitting 127 is secured to the upper mounting plate 113 with a threaded inlet end 129 extending above the upper mounting plate 113 and a nozzle 131 extending into the space between the third and fourth shells 111*c* and 111*d*. The outlet line 7 from the activation assembly 1 is threadingly coupled to the threaded inlet end 129 of inlet fitting 127. The nozzle generally extends perpendicular to and opens perpendicular to the threaded inlet end 129 so that a cyclonic or swirling motion is imparted on liquid introduced under pressure into the hydration chamber 9 through nozzle 131.

The mixture of supply water and activated polymer forming suspension introduced into the hydration chamber 9 through nozzle 131 swirls around the space between outermost shell 111*d* and third shell 111*c*, through passageways 123*c* and into and around the space between third shell 111*c* and second shell 111*b*, then through passageways 123*b* and into and around the space between second shell 111*b* and innermost shell 111*a*, then through passageways 123*a* and into the innermost shell 111*a* and then out outlet opening 119 and outlet fitting 121 and into discharge line 11.

Shells 111*a*, 111*b* and 111*c* may also be referred to as baffles and function to increase the residence time of the mixture of supply water and activated polymer forming suspension in the hydration chamber 9 to permit greater polymerization and chain growth of the activated polymer. Grooves may be formed in the inner surfaces of the upper and lower mounting plates 113 and 114 to receive ends of the shells 111*a-d* with o-rings positioned in the outermost groove between the ends of the outermost shell 111*d* and the upper and lower mounting plates 113 to 114 to form a seal therebetween. A drain port 135 is shown formed in the lower mounting plate 114 in line with the space between the third and fourth shells 111*c* and 111*d* with a drain channel 137 also formed in the inner surface of the lower mounting plate 114 and extending from the drain port 135 toward the center of innermost shell 111*a* and extending below the lower edge of each of the shells 111*a-c*, so that liquid may be drained from each of the shells 111*a-d* by removing a plug 138 inserted in drain port 135. The shells 111*a-d* are clamped in place between the upper and lower mounting plates 113 and 114 by bolts 139 extending around the periphery of the outermost shell 111*d*.

It is to be understood that while certain forms of the present invention have been illustrated and described herein, it is not to be limited to the specific forms or arrangement of parts described and shown.

What is claimed is:

1. A polymer activation assembly comprising:

a primary fluid channel extending through said polymer activation assembly along a first axis, the primary fluid channel having a primary fluid channel inlet, a primary fluid channel outlet and an activation portion therebetween wherein said activation portion of said primary fluid activation channel is wider than it is deep;

a secondary fluid channel having a secondary fluid channel inlet connecting to a nozzle section which intersects the activation portion of the primary fluid channel at an acute angle and which is wider than it is deep.

2. The polymer activation assembly as in claim 1 wherein said activation portion of said primary fluid activation channel is rectangular in cross-section.

3. The polymer activation assembly as in claim 1 wherein a surface of the polymer activation assembly defining said activation portion of said primary fluid activation channel opposite said nozzle is generally planar.

4. The polymer activation assembly as in claim 1 wherein said nozzle section is rectangular in cross-section.

5. The polymer activation assembly as in claim 1 wherein a distal end of said nozzle section is approximately the same width as the width of said activation portion of said primary fluid channel.

6. The polymer activation assembly as in claim 2 wherein said nozzle section is rectangular in cross-section and a distal end of said nozzle section is approximately the same width as the width of said activation portion of said primary fluid channel.

7. The polymer activation assembly as in claim 1 wherein said nozzle section angles toward said primary fluid channel outlet.

8. The polymer activation assembly as in claim 1 in combination with a hydration assembly wherein the hydration assembly comprises a plurality of flow connected, concentric chambers formed from cylindrical shells of increasing diameter secured between first and second mounting plates with an inlet opening extending through one of the mounting plates in communication with a first of an innermost or outermost concentric chamber and an outlet opening extending through one of the mounting plates and in communication with a second of the innermost or outermost concentric chamber.

9. The combination as in claim 8 wherein said inlet opening of said hydration assembly is flow connected to said primary fluid channel outlet of said polymer activation assembly.

10. The combination as in claim 8 further comprising a nozzle connected to said inlet opening of said hydration assembly and oriented within said innermost or outermost concentric chamber to impart a swirling motion on liquid introduced into the hydration chamber through said nozzle.

11. A polymer activation assembly comprising:

a casing and first and second blocks securable within an interior chamber of said casing;

a primary fluid channel having an inlet end and an outlet end is formed between said first and second blocks; said primary fluid channel is rectangular in cross-section and wider than it is deep along at least an activation portion extending between said inlet and outlet ends thereof;

a secondary fluid channel having a secondary fluid channel inlet connecting to a nozzle section which intersects the activation portion of the primary fluid channel at an acute angle and which is wider than it is deep a primary fluid inlet is formed through a first end of said casing and extends in flow communication with said inlet end of said primary fluid channel;

a mixed fluid outlet is formed through a second end of said casing and extends in flow communication with said outlet end of said primary fluid channel; and a secondary fluid inlet is formed through a side of said casing and extends in flow communication with said secondary fluid channel inlet.

12. The polymer activation assembly as in claim 11 wherein said nozzle section is rectangular in cross-section.

13. The polymer activation assembly as in claim 11 wherein a distal end of said nozzle section is approximately the same width as the width of said activation portion of said primary fluid channel.

14. The polymer activation assembly as in claim 11 wherein said nozzle section is rectangular in cross-section and a distal end of said nozzle section is approximately the same width as the width of said activation portion of said primary fluid channel.

15. The polymer activation assembly as in claim 11 wherein said nozzle section angles toward said outlet end of said primary fluid channel.

16. The polymer activation assembly as in claim 11 wherein said casing is formed from an inlet casing and an outlet casing with the primary fluid inlet and the secondary fluid inlet formed through the inlet casing and the mixed fluid outlet formed through the outlet casing.

17. The polymer activation assembly as in claim 11 further comprising a hydration assembly wherein the hydration assembly comprises a plurality of flow connected, concentric chambers formed from cylindrical shells of increasing diameter secured between first and second mounting plates with an inlet opening extending through one of the mounting plates in communication with a first of an innermost or outermost concentric chamber and an outlet opening extending through one of the mounting plates and in communication with a second of the innermost or outermost concentric chamber.

18. The polymer activation assembly as in claim 17 wherein said inlet opening of said hydration assembly is flow connected to said mixed fluid outlet of said polymer activation assembly.

19. The polymer activation assembly as in claim 18 further comprising a nozzle connected to said inlet opening of said hydration assembly and oriented within said innermost or outermost concentric chamber to impart a swirling motion on liquid introduced into the hydration chamber through said nozzle.

* * * * *